US006370930B1

(12) United States Patent
Lee et al.

(10) Patent No.: US 6,370,930 B1
(45) Date of Patent: Apr. 16, 2002

(54) CONTINUOUS SHEAR DEFORMATION DEVICE

(75) Inventors: Jae-Chul Lee; Hyun-Kwang Seok; Jong-Woo Park; Young-Hoon Chung; Ho-In Lee, all of Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 0 days.

(21) Appl. No.: 09/638,761

(22) Filed: Aug. 15, 2000

(30) Foreign Application Priority Data

May 6, 2000 (KR) ..... 2000-24221

(51) Int. Cl.[7] ..... B21C 23/00

(52) U.S. Cl. ..... 72/262; 72/253.1; 72/256; 72/270

(58) Field of Search ..... 72/253.1, 256, 72/259, 262, 255, 257, 270, 289

(56) References Cited

U.S. PATENT DOCUMENTS 4,044,587 A * 8/1977 Green et al. ..... 72/262
4,300,379 A * 11/1981 Johnson et al. ..... 72/262
4,362,485 A * 12/1982 Slater et al. ..... 72/262
4,823,586 A * 4/1989 Sinha et al. ..... 72/262

FOREIGN PATENT DOCUMENTS

JP 58-32514 * 2/1983 ..... 72/262
JP 1-241321 * 7/1989 ..... 72/262

OTHER PUBLICATIONS

An Experimental Study of Equal Channel Angular Extrusion (pp 437–442, Scripta Materialia, No. 4, vol. 37, 1997).
Plastic Working of Metals by Simple Shear 9pp 99–105, Russian Metallurgy, 1981).
Direct Observation of Shear Deformation during Equal Channel Angular Pressing of Pure Aluminum (pp 353–357), Scripta Materialia, No. 4, vol. 41, 1999).

* cited by examiner

*Primary Examiner*—Ed Tolan
(74) *Attorney, Agent, or Firm*—Scully, Scott, Murphy & Presser

(57) ABSTRACT

The present invention relates to a continuous shear deformation device. In order to occur shear deformation at the position at which a material is inserted into a molding path from a rotary guide apparatus for the purpose of solving the problem that the amount of shear deformation of a material is non-uniform and insufficient due to the gap between the curved portion of the molding path and the lower parts of the material, there is provided a continuous shear deformation device, characterized in that a curved portion is constructed by collaboration between the rotary guide apparatus and the molding path. In addition, there are provided additional constructions for effectively performing shear deformation by a small power by reducing the friction at the molding path excepting the curved portion. The present invention thusly constructed can be utilized for continuously and effectively mass-produce sheared materials.

14 Claims, 8 Drawing Sheets

CONTINUOUS SHEAR DEFORMATION DEVICE

BACKGROUND OF THE INVENTION

1. Field of the Invention

The present invention relates to a continuous shear deformation device, and more particularly, to a continuous shear deformation device suitable for making the amount of shear deformation of a material to be uniform throughout upper and lower parts of the material, increasing the amount of shear deformation, and occurring a rapid shear deformation.

2. Description of the Background Art

The shear deformation process is a process of obtaining a sheared material by passing a material into a mold for shear deformation having a molding path at which a curved portion is formed, and allowing shear deformation of the material to occur at the curved portion. This process has the object of fabricating a material of high strength and high plasticity by improving the strength of the material and forming a texture having a certain direction.

The above-mentioned shear deformation processes includes equal channel angular pressing (ECAP), equal channel angular drawing (ECAD), continuous ECAP process, and so on. FIGS. 1*a*, 1*b*, 2*a*, and 2*b* are views schematically illustrating shear deformation devices performing these shear deformation processes, respectively. As illustrated therein, the shear deformation devices are identical with one another in that each shear deformation device is constructed of molds 1, 2, 6, 7, 12, and 13 provided with molding paths 3, 8 and 14 having a curved portion shown in dotted line, but they are different from one another with respect to a means for applying power in order to passing materials 5 and 9 through the molds 3, 8 and 14.

Among these shear deformation processes, in case of equal channel angular pressing by which the material 5 is pushed out by a punch 4, only a sheared material of a limited length is obtained. Once the material is scalped, the next material can be provided only after extracting the punch 4 from the molds 1 and 2, so it is impossible to continuously mass-producing sheared materials. In case of equal channel angular drawing, although it is possible to mass-produce sheared materials, it is difficult to practically use this process because it has little effect for shear deformation. For the continuous mass production of materials having an appropriate amount of shear deformation, a continuous shear deformation device illustrated in FIGS. 2*a* and 2*b* which uses rotary guide apparatuses 10, 11, 15, and 16 in place of the punch 4 in order to continuously perform equal channel angular drawing is suitable.

However, the conventional continuous shear deformation device schematically illustrated in FIGS. 2*a* and 2*b* has the following problems.

First of all, in case of the continuous shear deformation device as illustrated in FIG. 2*a*, the friction surface between the material 9 and rotary rolls 10 and 11 of the rotary guide apparatus is so small that it is difficult to effectively push the material 9 into the molds 6 and 7. That is, the power for shear deformation of the material 9 in a curved portion, which is a part of the molding path 8 in the molds 6 and 7, and the power for overcome the friction force of the contact portion between the material 9 and the molds 6 and 7 must be applied to the material. Nevertheless, in case of the device illustrated in FIG. 2*a*, the friction surface between the material 9 and the rotary rolls 10 and 11 is so small that the above powers cannot be effectively transferred from the rotary guide apparatuses 10 and 11 toward the direction of the material.

In addition, as illustrated in FIG. 2*b*, in case of the continuous shear deformation device constructed in such a manner that the friction surface between the material 9 and the rotary roll 15 is increased, the above powers can be effectively transferred from the rotary guide apparatuses toward the direction of the material. However, it is difficult to machine a contact portion A simultaneously contacting the rotary guide apparatuses and the material, and the buckling phenomenon of the material is occurred due to the gap between the contact portion A and the material 9.

In addition, the conventional continuous shear deformation device illustrated in FIGS. 2*a* and 2*b* has a problem that the material is not tightly attached to a lower mold in the curved portion in the mold, thus making the amount of shear deformation of a lower part of the material insufficient. FIG. 3 is a view illustrating the calculation of the amount of shear deformation of a material in a curved portion in a mold by simulation. By this, it is known that a board plank is not completely attached to a molding surface at the curved portion directed by an arrow, but is isolated therefrom. Accordingly, it is known that the amount of shear deformation in the lower portions of the material is not sufficient as compared to other portions, which is confirmed by an actual experiment performed by the inventors. That is, the scales indicated in a vertical direction on the sides prior to shear deformation of the material as shown in FIG. 4*a* are indicated as shown in FIG. 4*b* after passing through the continuous shear deformation device, which indicates that the amount of shear deformation in the lower portions of the material is smaller than that in other portions.

In addition, in the conventional discontinuous or continuous shear deformation devices described above, a curved portion is formed at the center of molding path 3, 8 and 14 having the same width, and thus the movement of the material is inhibited by the friction at the molding path excepting the curved portion at which shear deformation is actually occurred. Therefore, a considerable power plus the power required for shear deformation in the curved portion has to be additionally applied to the materials, which is ineffective.

In addition, there is another problem that the life span of the molds is not long because the abrasion occurred adjacent the curved portion which receives the largest friction force from the molding paths rapidly performed as compared to other portions.

SUMMARY OF THE INVENTION

Accordingly, the objects of the present invention disclosed to overcome the problems encountered in the conventional art will now be described.

It is an object of the present invention to provide a continuous shear deformation device capable of effectively transferring power in the direction of a material from a rotary guide apparatus without difficulty in fabricating a mold, and thus smoothly performing shear deformation of the material.

It is another object of the present invention to provide a continuous shear deformation device having no possibility of buckling phenomenon of the material occurred at the entrance of a molding path.

It is still another object of the present invention to provide a continuous shear deformation device capable of obtaining an uniform and sufficient amount of shear deformation throughout the material by assuring contact between a lower part of the material and a curved portion in a molding path at which the material is sheared.

It is another object of the present invention to provide a continuous shear deformation device capable of assuring a longer life span of the mold.

It is another object of the present invention to provide a continuous shear deformation device which can be compatibly used in response to materials of different thickness, that is, from thin-walled materials to thick-walled materials.

To achieve the above objects, there is provided a continuous shear deformation device in accordance with the present invention which includes: a mold having a molding path which a material passes through; and a rotary guide apparatus for guiding the material to the molding path, wherein a curved portion is constructed by collaboration between the rotary guide apparatus and the opening of the molding path, so that shear deformation may be occurred at the position at which the material is inserted into the molding path from the rotary guide apparatus.

As the rotary guide apparatus, a rotary roll contacting materials, or a belt transmission for moving materials by rotating a belt contacting the materials can be used. As the belt, belts of various shapes, such as a roof having a plurality of polyhedron blocks sequentially connected to the same and a belt of which the inside is chain-shaped, can be used. In addition, the rotary guide apparatus can be a combination of the rotary roll and the belt transmission. For example, the rotary guide apparatus can be constructed by installing a plurality of rotary rolls at one side and a belt transmission at the other side. Also, in case of using the belt transmission, it is possible to use a combination of belts of various shapes.

To reinforce the friction between the material and the rotary guide apparatus, it is preferable that irregularity is formed on the surface contacting the material of the rotary guide apparatus, that is, the surface of the rotary roll or the belt. This is achieved by coating the surface using an additional material of high friction coefficient, or by increasing the surface roughness by forming irregularity by mechanical processing. In addition, it is also possible to fabricate a portion directly contacting the material throughout the entire rotary guide apparatus by using a material of high friction coefficient.

And, it is preferable that a lateral guide for guiding and supporting the lateral parts of the material is installed at the rotary guide apparatus in order to prevent the material from being bilaterally moved while passing through the mold for the purpose of shear deformation. Such a lateral guide can be installed at one of the rotary guide apparatus and the mold, or at both of them.

In addition, it is preferable to construct the continuous shear deformation device by installing the rotary guide apparatus and the mold as one part of a continuous processing equipment, in order to perform shear deformation as one process step in a continuous process for processing the material by means of multiple process steps. For example, the material can be heated at a desired temperature, and then can be sheared. In this case, it is possible to connect the continuous shear deformation device to an apparatus for heating the material. In a case where a cast or rolled material is directly sheared, the continuous shear deformation device can be connected to a continuous casting apparatus or a rolling apparatus. In addition, the continuous shear deformation device can be connected to an apparatus for cooling, cutting, flattening, or winding the material extracted from the continuous shear deformation device.

With respect to this, the thickness of the material before passing through the rotary guide apparatus may be larger than the thickness of the material after passing through the same. For example, it can be assumed that the rotary guide apparatus is constructed by using a series of pairs of rotary rolls, the spacing between which being gradually reduced. In this case, it is possible to provide a compatible continuous shear deformation device to materials of different thickness, for example, thin-walled materials of a thickness less than 0.5 mm and thick-walled materials, irrespective of thickness of the materials, by rolling the materials corresponding to the clearance spacing of a material supply path having a gradually reduced width formed by the rotary guide apparatus, without any additional processing of the materials.

It is natural that the amount of shear deformation of the material is adjusted according to the angle of the curved portion. Moreover, it is also possible to additionally form one or more curved portions at the molding path of the mold besides the curved portion at the opening, so that the material is sheared more than two times while passing through the molding path.

Friction is most apparent in the vicinity of the curved portion in the mold at which shear deformation is occurred. Thus, in order to improve the abrasion resistance of the vicinity of the curved portion, it is possible to fabricate that portion using an ultralight material. At this time, the vicinity of the curved portion can be coated with the ultralight material, or it can be entirely made of the ultralight material.

In addition, some part including the curve portion in the mold, which is greatly abraded during shear deformation, can be constructed as a separate, replaceable component.

In order to reduce the power applied in the direction of the material by decreasing the friction between the mold and the material, it is preferable that a lubricant applicator is additionally included.

As another construction for reducing friction force, it is preferable that the width of the molding path before the curved portion is formed to be larger than that of the molding path behind the curved portion, centering around the position spaced apart from the curved portion in the direction of the material, thereby reducing unnecessary friction between the material and the molding path.

Although the width of the molding path before the curved portion is identical with that of the molding path behind the curved portion in general, it is also possible to design and fabricate a mold of which the widths of the molding path before and behind the curved portion are different from each other, so that the thickness of the material before shear deformation is different from that of the material after shear deformation.

BRIEF DESCRIPTION OF THE DRAWINGS

The present invention will become better understood with reference to the accompanying drawings which are given only by way of illustration and thus are not limitative of the present invention, wherein:

FIGS. 2*a* and 2*b* are schematic views illustrating a conventional continuous shear deformation device, wherein FIG. 2*b* illustrates a continuous shear deformation device which is an improvement of the construction of FIG. 2*a* in order to increase the contact area between a material and a rotary roll;

FIGS. 4*a* and 4*b* are photographs illustrating the change in scale on the lateral parts of a material when shear deformation is made using the conventional continuous shear deformation device, wherein FIG. 4*a* illustrates the change in scale prior to deformation, and FIG. 4*b* illustrates the change in scale after deformation;

FIGS. 5*a* and 5*b* are schematic views illustrating a continuous shear deformation device in accordance with one embodiment of the present invention, wherein FIG. 5*a* illustrates a continuous shear deformation device using a pair of rotary rolls as a rotary guide apparatus, and FIG. 5*b* illustrates a continuous shear deformation device using a single rotary roll as a rotary guide apparatus;

DETAILED DESCRIPTION OF THE PREFERRED EMBODIMENTS

The preferred embodiments of the present invention will now be described in detail with reference to the accompanying drawings.

Figure 5A:
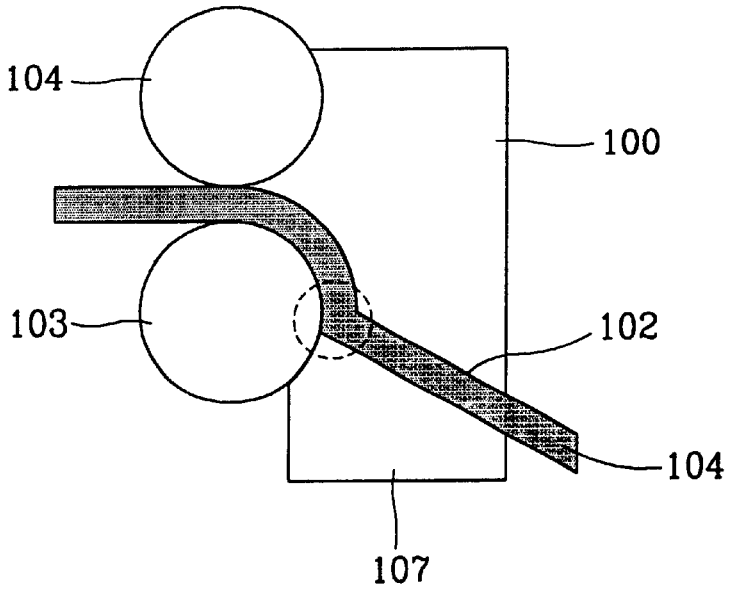
Figure 5B:
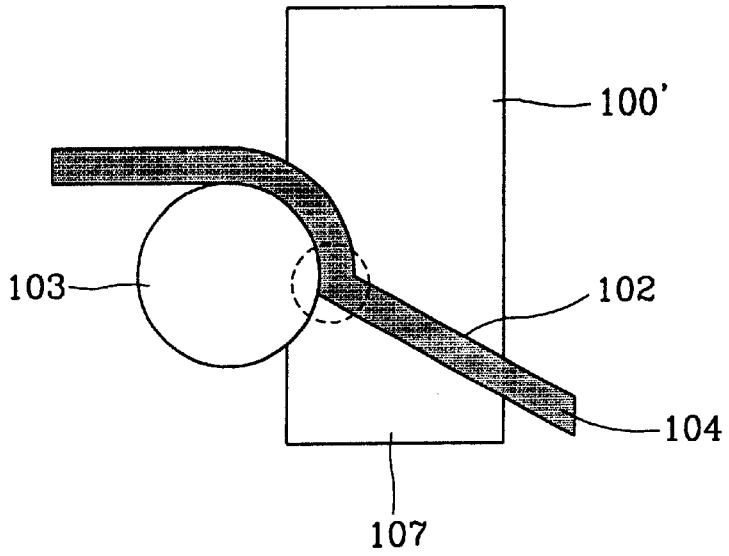

FIGS. 5*a* and 5*b* are schematic views illustrating continuous shear deformation devices each using two rotary rolls 103 and 104 or a single rotary roll 103 as a rotary guide apparatus in accordance with one embodiment of the present invention. The present invention includes molds 100, 100' and 101 having a molding path 102 which a material 104 passes through and a rotary guide apparatus for continuously guiding the material to the molding path 102, and is characterized in that a curved portion is constructed by collaboration between the rotary guide apparatus and the opening of the molding path 102, so that shear deformation of the material is occurred, not in the mold spaced apart from the rotary guide apparatus, but at the position at which the material is inserted from the rotary guide apparatus into the molding path 102.

Figure 1A:
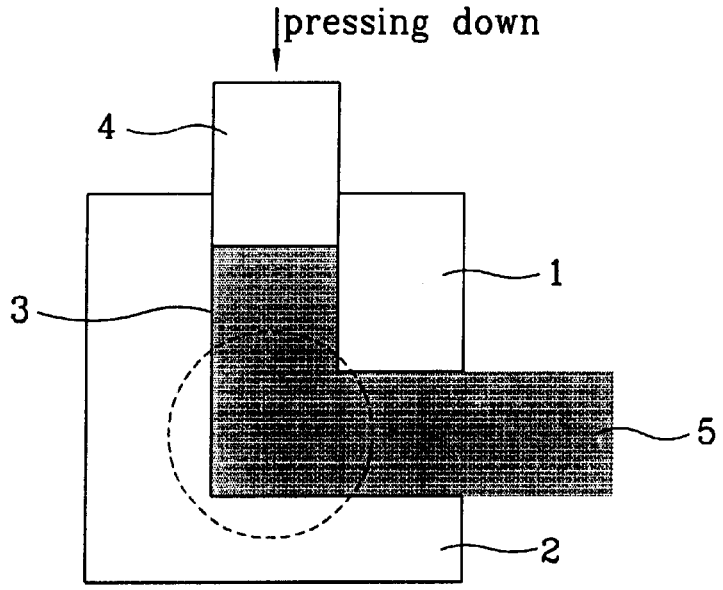
FIG. 1a PRIOR ART
FIG. 1*a* is a schematic view illustrating the device performing the conventional discontinuous equal channel angular pressing.
Figure 1B:
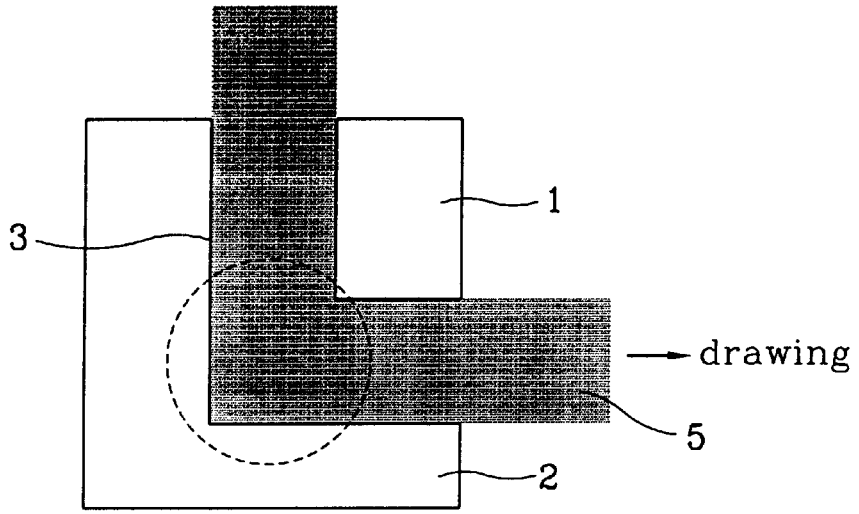
FIG. 1b PRIOR ART
FIG. 1*b* is a schematic view illustrating the device performing the conventional equal channel angular drawing is performed.
Figure 2A:
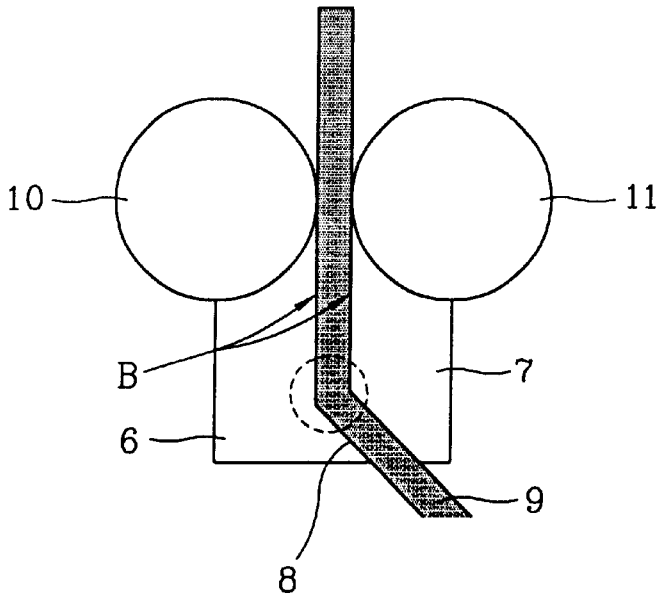
FIG. 2a PRIOR ART
Figure 2B:
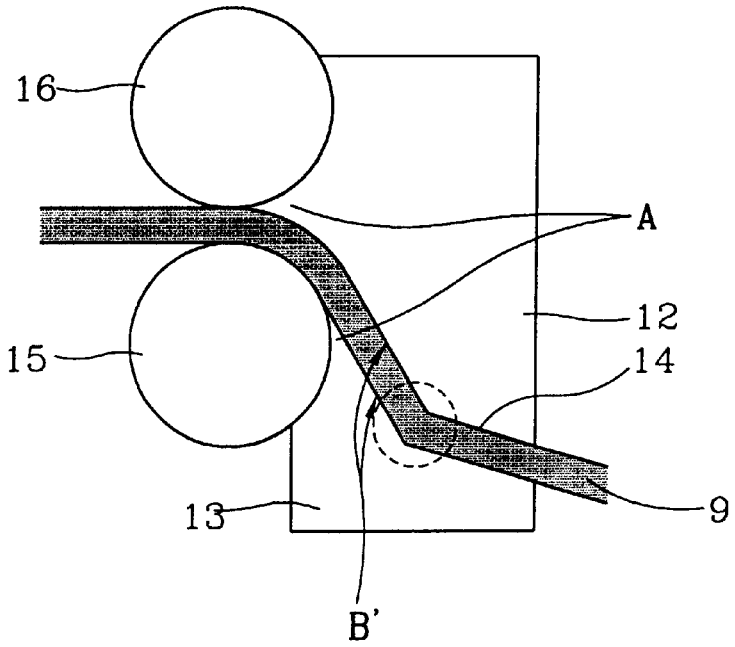
FIG. 2b PRIOR ART

That is, in the present invention, as illustrated in FIGS. 2*a* and 2*b*, unlike the conventional continuous shear deformation device having a curved portion at the central portion of the molding paths 8 and 14, the curved portion is constructed by collaboration between the opening of the molding path 102 and the rotary guide apparatus 103 at the position at which the mold 101 and the rotary guide apparatus 103 meet. Subsequently, there is no friction portion denoted by B and B' respectively in FIGS. 2*a* and 2*b*, that is, a friction portion between the molding paths 8 and 14 and the material 9 before the curved portion. Owing to this, the material can be transmitted to the curved portion by a smaller power and there is no difficulty in fabricating a mold, which is a problem in the conventional continuous shear deformation device as illustrated in FIG. 2*b*. In addition, the buckling phenomenon, which is occurred because the material and the molding path before the curved portion are not tightly attached to each other, is prevented since the rotary guide apparatus transmits the material to the curved portion while tightly attaching the material to the molding path, and it is possible to effectively transmit the material by a smaller power because the material and the rotary guide apparatus have a sufficient contact surface.

Figure 3:
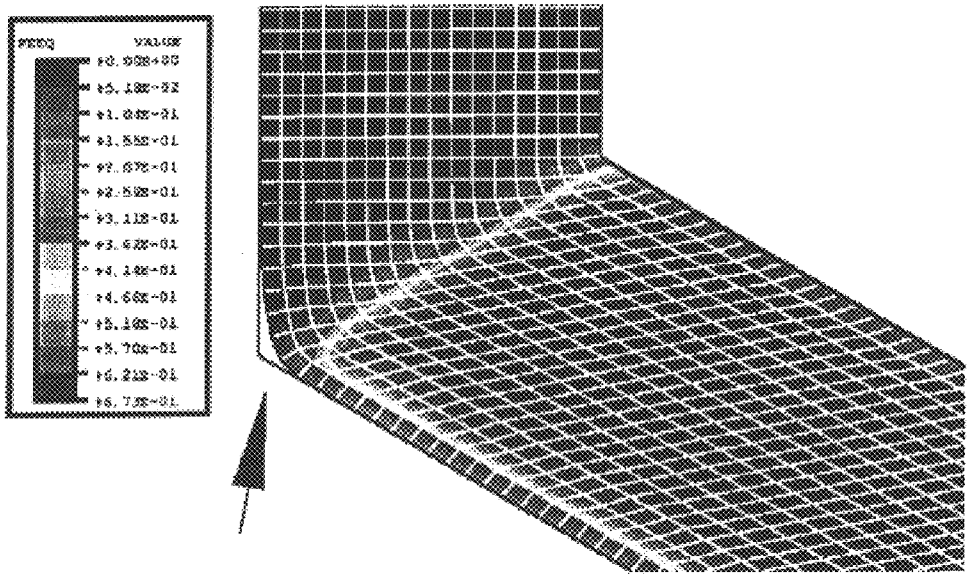
FIG. 3 is a view illustrating the deformation of a material occurred at a curved portion in a mold by means of simulation.
Figure 4A:
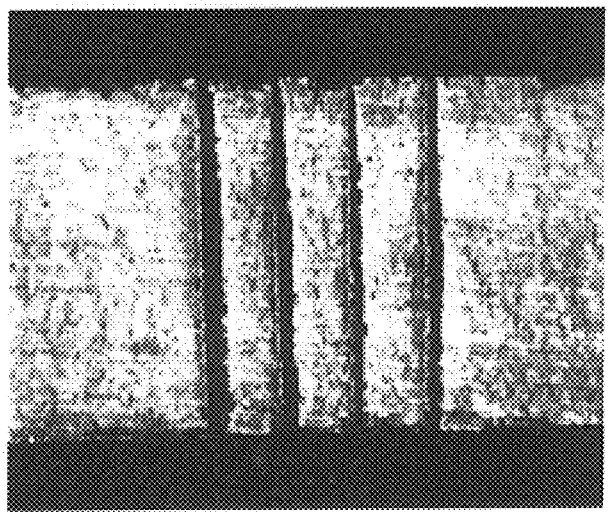
Figure 4B:
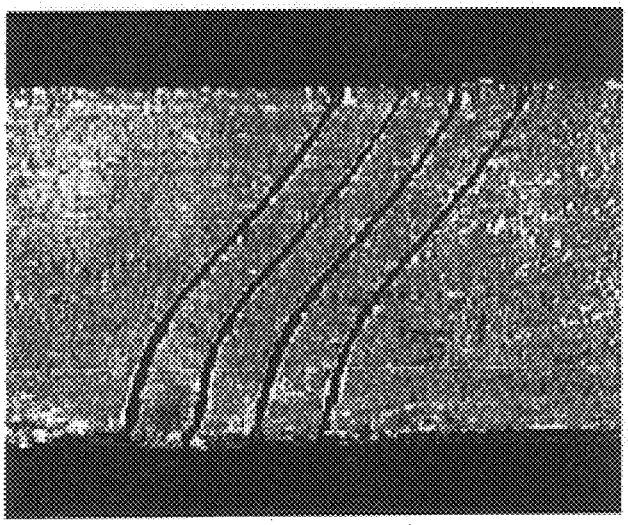
Figure 9:
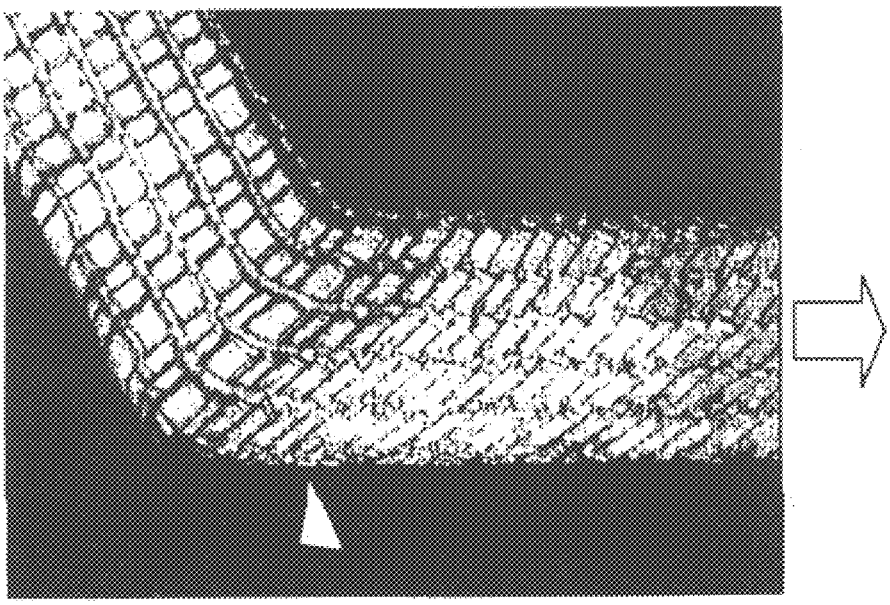
FIG. 9 is a photograph illustrating the change in scale on the lateral parts of a material by shear deformation in the case that the material is sheared by using a continuous shear deformation device in accordance with the present invention.

In addition, in the present invention, as the curved portion is formed at the position at which the material deviates from the rotary guide apparatus, the power of the rotary roll 103 or belt to press down the material 104 is directly applied to the material until shear deformation is initiated at the curved portion. Accordingly, it is possible to solve the problem expected in simulation of FIG. 3 and confirmed in an actual experiment of FIGS. 4*a* and 4*b*, that is, the problem that the lower parts of the material and the curved portion are not tightly attached for thereby making shear deformation insufficient and non-uniform, which is confirmed in FIG. 9, a photograph illustrating the change in scale on the lateral parts of a material by shear deformation in the case that the material is sheared by using a continuous shear deformation device in accordance with the present invention.

As the rotary guide apparatus, as illustrated in FIGS. 5*a* and 5*b*, the rotary rolls 103 and 104 contacting the material, or a belt transmission (not shown) for moving the material by rotating a belt contacting the material can be used. As the belt, belts of various shapes including a roof having a plurality of polyhedron blocks and a belt of which the inside is chain-shaped can be used. In addition, the rotary guide apparatus can be a combination of the rotary rolls and the belt transmission. For example, the rotary guide apparatus can be constructed by installing a plurality of rotary rolls at one side and a belt transmission at the other side. Also, in case of using the belt transmission, it is possible to use a combination of belts of various shapes.

Figure 6:
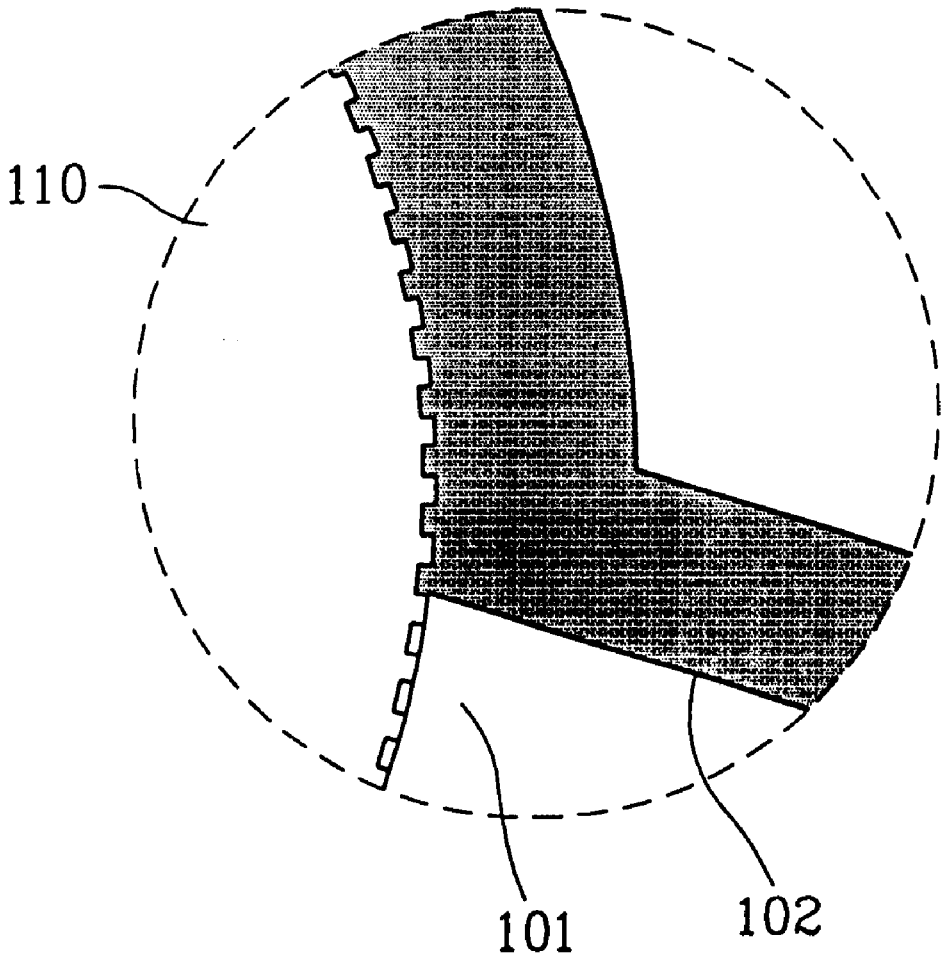
FIG. 6 is an expansion view illustrating the curved portion which is shown in dotted line of FIGS. 5*a* and 5*b;*

To reinforce the friction between the material and the rotary guide apparatus, as in FIG. 6 illustrating an expansion view of the curved portion shown in dotted line of FIGS. 5*a* and 5*b*, it is preferable that irregularity is formed on the surface contacting the material of the rotary guide apparatus, that is, the surfaces of the rotary roll 103 or the surface of the belt. This irregularity is achieved by coating the surface with an additional material of high friction coefficient, or by increasing the surface roughness by forming irregularity by mechanical processing. In addition, it is also possible to fabricate a portion directly contacting the material throughout the entire rotary guide apparatus by using a material of high friction coefficient.

And, it is preferable that a lateral guide for guiding and supporting the lateral parts of the material is installed at the rotary guide apparatus in order to prevent the material from being bilaterally moved while passing through the mold for the purpose of shear deformation. Such a lateral guide can be installed at one of the rotary guide apparatus and the mold, or at both of them, or at both of them as a plate girder contacting the lateral parts of the material.

In addition, although the above-described continuous shear deformation device can be used exclusively in no relation with other devices, it is preferable to construct the continuous shear deformation device by installing the rotary guide apparatus and the mold as one part of a continuous processing equipment, in order to perform shear deformation as one process step in a continuous process for processing the material by means of multiple process steps. For example, the material can be heated at a desired temperature, and then can be sheared. In this case, it is possible to connect the continuous shear deformation device to an apparatus for heating the material. In a case where a cast or rolled material is directly sheared, the continuous shear deformation device can be connected to a continuous casting apparatus or a rolling apparatus. In addition, the continuous shear deformation device can be connected to an apparatus for cooling, cutting, flattening, or winding the material extracted from the continuous shear deformation device.

Usually, the thickness of the material before and after passing through the rotary guide apparatus are identical with each other. However, in the present invention, the thickness of the material before passing through the rotary guide apparatus may be smaller than the thickness of the material after passing through the same. For example, it can be assumed that the rotary guide apparatus is constructed by using a series of pairs of rotary rolls, the spacing between which being gradually reduced. In this case, it is possible to provide a compatible continuous shear deformation device to materials of different thickness, for example, thin-walled materials of a thickness less than 0.5 mm and thick-walled materials, irrespective of thickness of the materials, by rolling the materials corresponding to the clearance spacing of a material supply path having a gradually reduced width formed by the rotary guide apparatus, without using any additional rolling apparatus.

Figure 7A:
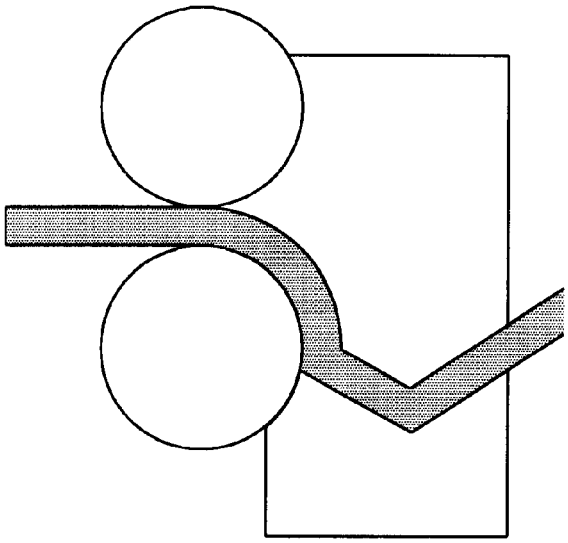
FIGS. 7*a* and 7*b* are schematic views illustrating a shear deformation device in accordance with another embodiment of the present invention, which includes a mold having two curved portions.
Figure 7B:
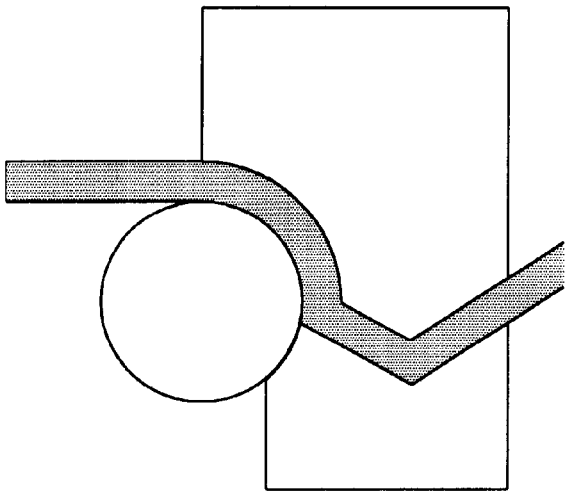

In the present invention, the amount of shear deformation of the material can be adjusted according to the angle of the curved portion. For instance, as the angle of the curved portion is increased, the amount of shear deformation is increased. In order to increase the amount of shear deformation, it is also possible to additionally form one or more curved portions at the molding path of the mold besides the curved portion at the opening, so that the material is sheared more than two times while passing through the molding path, as illustrated in FIGS. 7*a* and 7*b*.

In addition, to increase the amount of shear deformation of the material, the material having once passed through the continuous shear deformation device of the invention can be sheared while passing through the device at a desired number of times, or it is also possible that a desired number of continuous shear deformation devices are continuously installed, and then the material is sheared while passing through the devices.

Since friction is most apparent in the vicinity of the curved portion in the mold at which shear deformation of the material is occurred, the abrasion of the mold is most rapidly made. Thus, it is important to reduce the abrasion of that portion in order to increase the life span of the entire mold, so the vicinity of the curved portion is preferably made of ultralight material in order to improve the abrasion resistance of the vicinity the curved portion. At this time, the vicinity of the curved portion can be coated with the ultralight material, or it can be entirely made of the ultralight material.

In addition, one portion including the curve portion in the mold, which is greatly abraded during shear deformation, can be constructed as a separate, replaceable component, being separated from other portions of the mold.

The press-fit power, that is, the power of the rotary guide apparatus applied in the direction of the material corresponds to the power for shear deformation in the vicinity of the curved portion and the friction force between the mold and the material in the other portions. Thus, in order to perform shear deformation by a small press-fit power, it is important to decrease the friction force between the material and the mold excepting the curved portion. For this, it is preferable that a lubricant applicator is additionally included.

Figure 8:
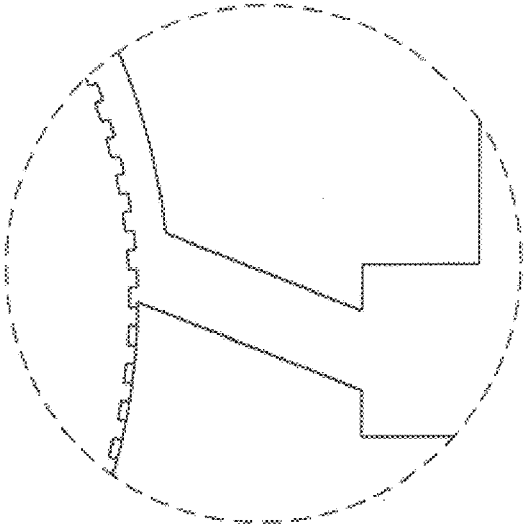
FIG. 8 is a schematic view illustrating a shear deformation device in accordance with still another embodiment of the present invention, wherein the width of a molding path is expanded at the position spaced apart from a curved portion.

As another construction for reducing friction force, as illustrated in FIG. 8, it is preferable that the width of the molding path before the curved portion is formed to be larger than that of the molding path behind the curved portion, centering around the position spaced apart from the curved portion in the direction of the material, thereby reducing unnecessary friction between the material and the molding path.

Generally, the width of the molding path before the curved portion is identical with that of the molding path behind the curved portion in order to make the thickness of the material before the curved portion identical with the thickness of the material in rear of the curved portion. However, if necessary, as illustrated in FIG. 8, it is also possible to design and fabricate a mold of which the widths of the molding path before and behind the curved portion are different from each other, so that the thickness of the material before shear deformation is different from that of the material after shear deformation. Herein, the decrease of the widths occurred when the material passes through the molding path is illustrated, and the increase thereof is, of course, also possible.

In case of using the thusly constructed continuous shear deformation device in accordance with the present invention, it is possible to effectively transfer power in the direction of a material from a rotary guide apparatus without difficulty in fabricating a mold, and thus smoothly performing shear deformation of the material.

In addition, there is no possibility of buckling phenomenon of the material occurred at the entrance of the molding path, and it is possible to obtain an uniform and sufficient amount of shear deformation throughout the material by reinforcing contact between the lower parts of the material and the curved portion in the molding path at which the material is sheared.

And, by reducing the friction between the material and the mold at the molding path excepting the curved portion at which shear deformation is occurred, it is possible to effectively press-fit the material by a small power and to increase the life span of the mold.

In addition, in case of using the rotary guide apparatus in accordance with the present invention, the apparatus can be compatibly used corresponding to materials of different thickness, that is, thin-walled materials and thick-walled materials without any additional process.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A continuous shear deformation device, comprising:

a mold having a molding path which a material passes through; and a rotary guide apparatus for guiding the material to the molding path, wherein a curved portion is constructed by collaboration between the rotary guide apparatus and the opening of the molding path, so that shear deformation occurs at a position at which the material is inserted into the molding path from the rotary guide apparatus.

2. The device of claim 1, wherein the rotary guide apparatus comprises a rotary roll contacting the material.

3. The device of claim 1, wherein the rotary guide apparatus comprises a belt transmission for moving the material by rotating a belt contacting the material.

4. The device of claim 3, wherein the belt is a roof having a plurality of polyhedron blocks sequentially connected to the same.

5. The device of claims 1, 2, 3, or 4, wherein irregularity is formed on the surface contacting the material of the rotary guide apparatus to reinforce the friction between the material and the rotary guide apparatus.

6. The device of claims 1, 2, 3, or 4, wherein one or more curved portions is additionally formed at the molding path of the mold besides the curved portion at the opening, so that the material is sheared more than two times while passing through the molding path.

7. The device of claims 1, 2, 3, or 4, wherein the vicinity of the curved portion is fabricated using an ultralight material in order to improve the abrasion resistance of the vicinity of the curved portion.

8. The device of claims 1, 2, 3, or 4, wherein some part including the curve portion in the mold, which is greatly abraded during shear deformation, is constructed as a separate, replaceable component.

9. The device of claims 1, 2, 3, or 4, wherein the continuous shear deformation device further comprises a lubricant applicator in order to reduce the power applied in the direction of the material by decreasing the friction between the mold and the material.

10. The device of claims 1, 2, 3, or 4, wherein the width of the molding path before the curved portion is formed to be larger than that of the molding path behind the curved portion, centering around the position spaced apart from the curved portion in the direction of the material.

11. The device of claims 1, 2, 3, or 4, wherein the widths of the molding path before and behind the curved portion are different from each other.

12. The device of claims 1, 2, 3 or 4, wherein the rotary guide apparatus and the mold are installed as one part of a continuous processing equipment, in order to perform shear deformation as one process step in a continuous process for processing the material by means of multiple process steps, the steps comprising at least one of (a) heating the material, (b) casting the material, (c) rolling the material, (d) cooling the material, (e) cutting the material, (f) flattening the material, and (g) winding the material.

13. The device of claims 1, 2, 3 or 4, wherein the rotary guide apparatus further comprises a rolling means for gradually reducing the thickness of the material guided to the mold and rolling the material into the mold.

14. The device of claims 1, 2, 3 or 4, wherein one or more curved portions are additionally formed at the molding path of the mold besides the curved portion at the opening, so that the material is sheared more than two times while passing through the molding path.

* * * * *